United States Patent [19]

Stumpp

[11] 4,161,933

[45] Jul. 24, 1979

[54] MIXTURE CONTROL APPARATUS FOR INTERNAL COMBUSTION ENGINES

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 816,844

[22] Filed: Jul. 18, 1977

[30] Foreign Application Priority Data

Sep. 3, 1976 [DE] Fed. Rep. of Germany ..... 2639768

[51] Int. Cl.[2] ..... F02M 39/00

[52] U.S. Cl. ..... 123/139 AW; 123/119 R; 123/139 BG; 123/32 EJ

[58] Field of Search ..... 123/139 AW, 119 EC, 123/32 EJ, 139 BG, 119 R

[56] References Cited

U.S. PATENT DOCUMENTS

| | | | |
|---|---|---|---|
| 3,796,200 | 3/1974 | Knapp | 123/139 AW |
| 3,896,778 | 7/1975 | Zeyns et al. | 123/139 AW |
| 3,915,138 | 10/1975 | Eckert et al. | 123/139 AW |
| 3,951,120 | 4/1976 | Schlott | 123/139 AW |
| 4,015,571 | 4/1977 | Stumpp | 123/139 AW |
| 4,018,200 | 4/1977 | Stumpp et al. | 123/139 AW |
| 4,026,259 | 5/1977 | Meyerdierns et al. | 123/139 AW |
| 4,031,873 | 6/1977 | Banzhaf et al. | 123/139 BG |
| 4,058,100 | 11/1977 | Tanaka et al. | 123/139 AW |
| 4,072,137 | 2/1978 | Hattori et al. | 123/119 EC |
| 4,083,342 | 4/1978 | Bertling | 123/119 EC |

*Primary Examiner*—Charles J. Myhre
*Assistant Examiner*—R. A. Nelli
*Attorney, Agent, or Firm*—Edwin E. Greigg

[57] ABSTRACT

A mixture control device for a fuel-injected internal combustion engine in which an air flow meter in the induction tube is associated with a slide valve which opens and closes a fuel metering orifice. A differential pressure valve is connected across the metering orifice and one chamber of the differential pressure valve is connected to a servo-motor which moves the main fuel control rod of the fuel injection system. When the amount of fuel delivered to the engine is different from that metered out by the orifice, the pressure in the differential valve changes, causing a temporary admission of pressurized fuel to the servo-motor, which adjusts the position of the main fuel control rod until equilibrium is re-established. Several embodiments are presented, including exhaust gas recycling.

21 Claims, 5 Drawing Figures

MIXTURE CONTROL APPARATUS FOR INTERNAL COMBUSTION ENGINES

BACKGROUND OF THE INVENTION

The invention relates to an apparatus for regulating the fuel air ratio of the combustible mixture fed to the cylinders of an internal combustion engine. More particularly, the invention relates to a regulator in which the fuel quantity is adjusted arbitrarily while the airflow rate is measured and causes a fuel throttle to limit the amount of fuel provided to the engine. The apparatus compares the fuel quantity provided to the engine with the correct quantity admitted by the air-flow related metering system and corrects the delivered fuel quantity accordingly. Known in the art is an apparatus in which the airflow rate to the engine is set arbitrarily while a throttling member in the fuel supply line meters out the correct fuel and where a differential pressure valve controls a second throttle for correcting any deviation of the differential pressure accross the metering aperture.

Also known in the art is an apparatus in which the injected fuel quantity is changed arbitrarily and where any change in the differential pressure across the fuel metering aperture which is controlled by the airflow rate meter causes a differential pressure valve to throttle the airflow through the induction tube. Accordingly, the changed airflow rate corrects the previously detected deviation of the differential pressure and thus maintains a desired fuel-air ratio of the combustible mixture.

The known apparatus is distinguished by requiring a throttling device for the aspirated air as well as an airflow metering device. It is well known, however, that throttling of the air passages in an engine results in a disadvantageous reduction of the power which the engine is capable of producing. Furthermore, in the known apparatus, the fuel-air ratio can be corrected only after the disturbance caused by the change in fuel quantity has traveled over a relatively long control path which is thus subject to a large number of disturbing influences. In particular, a change in the differential pressure first causes a control pressure for the actuation of the air throttling mechanism as a consequence of which the airflow rate changes and causes the airflow rate meter to alter the fuel supply via a throttle operated thereby. The various transfers may introduce errors which falsify the fuel-air ratio.

OBJECT AND SUMMARY OF THE INVENTION

It is a principal object of the invention to provide a regulator for regulating the fuel air ratio of the combustible mixture of an internal combustion engine which is distinguished from known apparatus by employing a substantially shortened control path and thereby being simple to construct and being less subject to disturbing influences.

It is a further object of the invention to provide an apparatus for regulating the fuel-air mixture of an internal combustion engine which is independent of any influences occuring downstream of the fuel metering device, for example, pressure fluctuations, changes in the flow cross section tolerances, or other changes due to wear and tear in the metering system.

Another object of the invention is to provide a fuel mixture control apparatus which sets the injected fuel quantity per unit time independently of the operational state of the vehicle in which the engine may be used, for example in overrunning, i.e., engine braking operation.

Still another object of the invention is to provide an apparatus in which the pressure difference across the throttling member is held constant so that the curves describing the fuel quantity per metering cycle are hyperbolic functions of the RPM, resulting in satisfactory performance characteristics.

These and other objects are obtained according to the invention by providing a fuel control apparatus for controlling the fuel air mixture supplied to an internal combustion engine and including an arbitrarily adjustable fuel metering device as well as an airflow rate meter. The airflow rate meter displaces a throttling member in the fuel supply line leading to the fuel metering system. Connected in parallel with the fuel throttling member is a differential pressure valve, the pressure chamber of which is connected to the fuel supply lines upstream of the fuel throttling member and is also connected to act on the arbitrarily adjustable fuel metering device. As soon as the adjusted differential pressure is altered by a movement of the fuel throttling member, a relief line may be opened to admit pressurized fuel to the fuel metering device to thereby correct the deviation in the differential pressure. Thus, by appropriately setting the differential pressure and suitably dimensioning the airflow meter it is possible to obtain a maximum fuel quantity associated with each airflow rate independently of any manufacturing tolerances and wear and tear of the remaining portions of the fuel supply system.

Particular embodiments of the invention to be described in detail below result in further advantages. By coupling the fuel quantity metering member of the system with an arbitrarily setable lever is possible to preset the engine load and to adjust the injected fuel quantity according to the desired fuel-air ratio by a correction of the position of the fuel metering member. In this manner, the amount of force required to set the fuel quantity becomes independent of rpm.

It is a favorable feature of the invention that the airflow meter is a disc disposed pivotably and transversely in the induction tube of the engine and moving in a suitably shaped portion of the induction tube against a substantially constant restoring force. The airflow meter is connected to and displaces the fuel throttling member. By suitable shaping of the air funnel in which the airflow meter disc moves, it is possible to provide a very precise adaptation of the injected fuel quantity as a function of rpm for full load beginning with an enrichment at engine startup up to top rpm and thus to obtain smokeless and nontoxic combustion especially when used in diesel engines for example. This advantage obtains in both turbo-charged and suction type engines. In this embodiment, an arbitrarily setable stop limits the displacement of the airflow measuring disc or of the fuel throttling member so that the fuel quantity per unit time may be kept constant throughout the engine operation. Thus, changes in the fuel metering system due to wear and tear have no effect on the fuel quantity.

The invention will be better understood as well as further objects and advantages have become more apparent from the ensuing detailed description of four exemplary embodiments taken in conjunction with the drawing.

DESCRIPTION OF THE PREFERRED EMBODIMENTS

Figure 1:
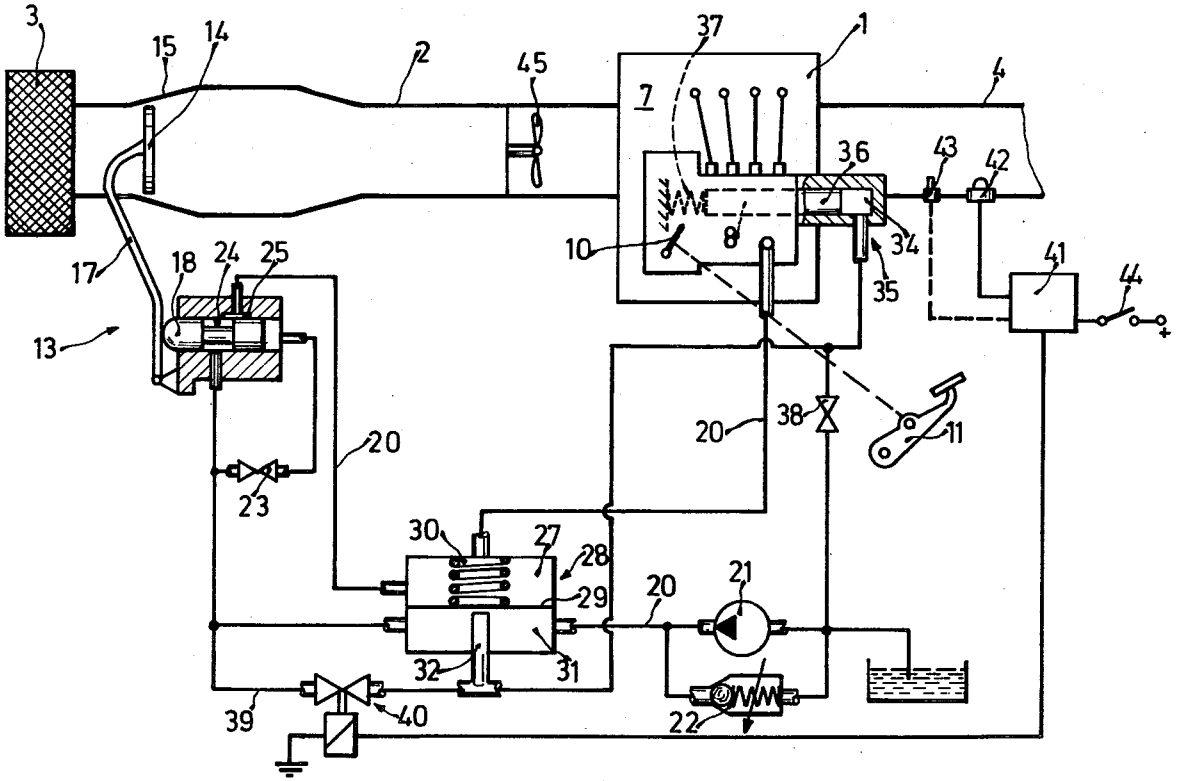
FIG. 1 is a schematic illustration of a first exemplary embodiment of the invention including arbitrary setting of the fuel supply.

Turning now to FIG. 1, there will be seen a simplified illustration of an internal combustion engine 1 including an induction tube 2 equipped with an air filter 3 and an exhaust manifold 4. The combustion chambers of the engine are supplied with fuel by an injection pump 7 illustrated as an exemplary serial injection pump. The fuel metering occurs via a fuel metering element 8, which in this case may be for example the control rod of the serial injection pump. The metering member is displaced by a lever 10 which may be coupled to an accelerator pedal 11.

Located at the inlet side of the engine is an air-flow meter 13, comprising a disc 14 which is positioned pivotably in a conically enlarged air funnel 15 of the induction tube and which is displaced by the inflowing air in opposition to a substantially constant restoring force. The disc is mounted on a lever 17 which pivots with low friction about a fixed point and which is engaged in the sense of a return force by a control slide 18, itself exposed on one face to substantially constant fuel pressure. The fuel control device of which the control slide 18 is the moveable member is connected astride a fuel supply line 20 leading from a fuel pump 21 to the fuel injection pump 7. A pressure control valve 22 maintains the fuel pressure in the line 20 substantially constant.

A point in the fuel supply line upstream of the control slide 18 is connected through a damping throttle 23 to the rear face of the control slide. An annular groove 24 on the control slide 18 cooperates with a metering cross section 25 to change the effective flow cross section in the fuel line.

Downstream of the control slide 18, the fuel supply line 20 is passed through one pressure chamber 27 of a differential pressure valve 28 and is continued to the injection pump 7. In a known manner, the differential pressure valve 28 includes a diaphragm 29 which defines the uncontrolled pressure chamber 27 in which a compression spring 30 is located to bias the diaphragm from a control pressure chamber 31. The latter receives fuel pressure from upstream of the control slide 18, and also includes a valve seat which cooperates with the diaphragm and is connected to a relief line 32. The relief line 32 leads to the pressure chamber 34 of a servo motor 35 whose piston 36 displaces the fuel metering member 8 of the injection pump in opposition to the force of a spring 37. A fixed throttle 38 connects the pressure chamber 34 to the suction side of the fuel pump 21.

The relief line 32 is further connected via a line 39 including a solenoid valve 40 to the fuel supply line upstream of the control slide 18. The solenoid valve 40 may be actuated continuously or cyclically by a known and suitably constructed electronic controller 41 which receives signals from sensors 42 or 43 related to the constitution of the exhaust gases. The controller 41 is supplied with electric current by a switch 44 which may be connected, for example, to the ignition switch of the vehicle in which the engine is used.

In an optional construction, the induction tube includes a supercharger 45 for condensing the air prior to admission to the engine in order to improve the output power.

The exemplary embodiment described above functions as follows. Assuming an initially constant operation of the engine, if the fuel quantity is increased by displacement of the fuel quantity metering element 8, and if the load remains constant, the engine speed will increase. In response to the increased engine speed the airflow rate in the induction tube increases, thereby displacing the disc 14 until the return force exerted by the control slide 18 is just balanced by the static pressure between the disc and the funnel 15. Accordingly, the control slide 18 is displaced and the metering cross section 25 is increased, admitting a larger amount of fuel through the pressure chamber 27 to the injection pump 7. If the amount of fuel passing through the pressure chamber 27 is different from the quantity actually provided to the engine however, the pressure in the pressure chamber 27 will change. In particular, if the pressure decreases, the valve 32 opens, thereby admitting a pressure defined by the throttle 38 into the chamber 34 of the servo motor 35. This pressure tends to displace the fuel metering member 8 in the direction of a reduced fuel quantity, thereby correcting the initial change until such time as the differential pressure valve 28 is again in equilibrium. In this way, the adjustable pressure difference set by the spring 30 in the valve 28 is maintained at all times across the metering opening 25 by corrective displacement of the fuel metering member 8. Accordingly, the fuel delivered to the pump 7 is proportional to the size of the metering cross-section 25. The fuel delivered to the engine thus depends only on the position of the control slide 18 and not on the overall condition of the injection pump and the state of maintenance of, for example, the fuel injection nozzles.

By appropriately shaping the contour of the air funnel 15, it is possible to incorporate into the desired fuel-air ratio additional factors such as warm-up enrichment and a negative or positive adaptation of the fuel quantity at full load operation. It is thus possible to extend the range of operation especially of diesel engines up to the smoke limit, thereby permitting maximum performance. The same will hold for the operation of a supercharged engine because the airflow meter always measures the actual aspirated airflow rate.

Further possibilities for adjustment are provided by controlling the electromagnetic valve 40 on the basis of selected parameters of the engine, thereby increasing the pressure in the chamber 34 and causing a displacement of the fuel metering member 8 in the direction of a reduced quantity. For example, the electronic circuit 41 may receive a signal related to the exhaust gas temperature and open the electromagnetic valve 40 when a given reference temperature is exceeded. In the same way the magnetic valve 40 could also be controlled on the basis of the magnitude of the smoke density of the exhaust gases. The composition of the exhaust gases could be sensed by the sensor 42 and the related signal could be used to actuate the magnetic valve 40 either cyclically or continuously. A cyclic actuation is advantageous because the electromagnetic valve 40 may be embodied as a switching valve which is normally open when currentless. Thus the fuel supply may be completely shut off by opening the switch 44, thus permitting the entire fuel pressure to reach the chamber 34, thereby displacing the fuel metering member in the direction of a zero quantity.

Further possibilities for adjusting the fuel metering to the requirements of the engine are provided by the presence of the controllable pressure valve 22 which may be actuated in known manner in dependence on the temperature or the ambient pressure. For example, by lowering the fuel pressure in the supply line 20, the resultant reduced restoring force permits a relatively greater displacement of the disc 14 for the same airflow rate, thereby increasing the metered fuel. A compensation for the influence of fuel temperature may be performed by the installation of a bimetallic i.e. temperature responsive spring acting in parallel with the compression spring 30. Alternatively, the spring 30 may itself be constructed as a bimetallic spring. In this manner, the differential pressure across the metering aperture 25 is varied in temperature-dependent fashion permitting the fuel quantity to be appropriately adjusted.

Figure 2:
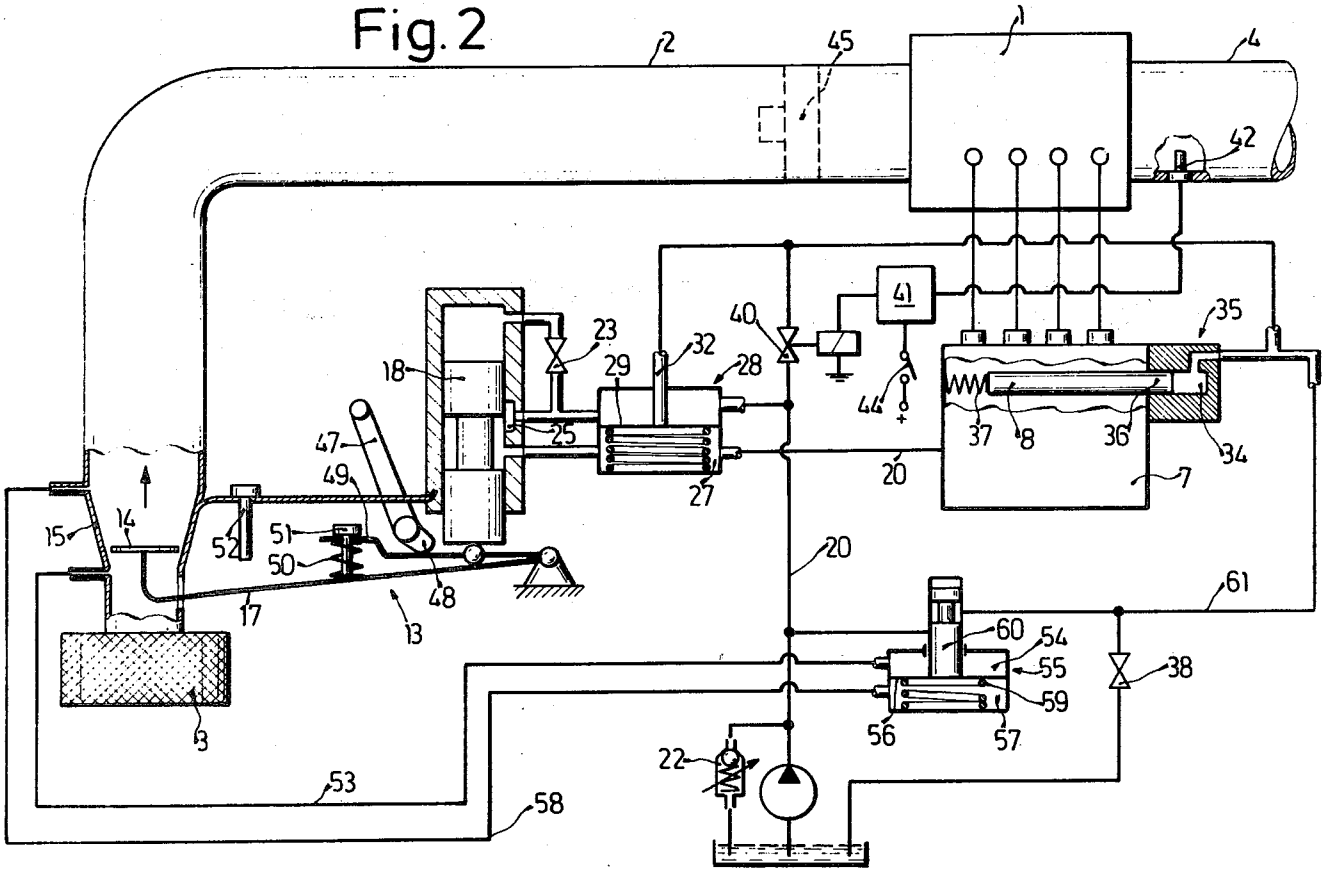
FIG. 2 is an illustration of a second exemplary embodiment of the invention with arbitrary setting of the maximum displacement of the airflow meter.

A second exemplary embodiment of the invention is illustrated in FIG. 2 in which elements identical or similar to those of FIG. 1 retain the same reference numerals. The second embodiment is seen to again include a fuel injection pump 7 for supplying fuel to the engine 1 which also obtains air through the induction tube 2 and, if required, via the turbo charger 45. Exhaust gases are collected in the exhaust manifold 4 which contains sensors 42 that detect the exhaust gas temperature, the exhaust gas coloring or exhaust gas composition. The fuel injection pump 7 may be a known serial injection pump or distributor injection pump having a main fuel metering element 8 which is engaged by a piston 36 of the servo motor 35 in opposition to a spring 37.

Just as in FIG. 1, the fuel throttling member is a control slide 18 located in the fuel supply line 20 for controlling the free opening of a metering orifice 25 across which a differential pressure valve 28 is connected in parallel. By contrast to the exemplary embodiment of FIG. 1, there is provided an intermediate lever 49 between the control slide 18 and the pivotal arm 17 of the airflow meter 13. Compressed between the intermediate lever 49 and the pivotal arm 17 is a spring 50 which pushes the intermediate lever 49 against a fixed stop 51 mounted on the pivotal arm 17. The tension of the spring 50 is chosen to be at least large enough that the spring holds the lever 49 against the stop 51 even when the control slide 18 is exerting a force. A further difference with respect to the exemplary embodiment of FIG. 1 is a lever 47 which takes the place of the arbitrarily settable lever 10 in the embodiment of FIG. 1 and which serves to adjust the position of a movable stop 48, for example an eccentric, located in the pivotal sweep of the intermediate lever 49. The position of the stop 48 determines and limits the maximum displacement of the intermediate lever 49 and hence also of the control slide 18. This limitation is also experienced by the plate 14 moving in the funnel 15 due to the presence of the spring 50.

There is further provided a fixed but adjustable stop 52 located in the pivotal sweep of the arm 17 for limiting the maximum displacement of the latter.

The operation and function of the apparatus according to FIG. 2 is the same as that of FIG. 1 with respect to identical elements. However, by contrast to the first embodiment, the arbitrary adjustment of the fuel quantity on the basis of load or rpm is performed directly at the control slide 18. Actuation of the lever 47 sets the maximum size of the metering cross section 25. For example if the engine is operating at constant speed and the metering cross section 25 is enlarged, the fuel pressure in the uncontrolled chamber 27 of the differential pressure valve 28 is at first increased. This causes a reduction of the flow cross section in the relief line 32 and thus decreases the pressure in the chamber 34 of the servo motor. This pressure decrease in turn causes the spring 37 to move the fuel quantity member 8 in the direction of an increased amount of fuel until the increased fuel causes the pressure in the differential pressure valve 28 to return to equilibrium. If the lever 47 is moved in the direction of a reduced quantity, the above described process takes place in reverse. The spring 50 serves to reduce the force acting on the lever 47. In the absence of the spring 50 and the intermediate lever 49, a return motion of the pivotal arm 17 would reduce the annular flow cross section formed between the air funnel 15 and the disc 14 and thus would transmit a substantially increased restoring force for the same engine speed in opposition to the direction of motion of the lever 47 via the pivotal arm 17. This would result in a sharp and undesirable temporary reduction of fuel. The disposition of the spring permits the displacement of the intermediate lever 49 during a decelerating motion of the lever 47, thereby compressing this spring somewhat. However, the motion of the intermediate lever is driven by the fuel pressure in the line 20 upstream of the control slide 18 so that there takes place a reduction of the fuel quantity and thus a reduction of the rpm or the airflow rate for the same condition of load. Subsequently the decreasing differential pressure at the disc 14 permits the spring 40 to relax.

The embodiment of FIG. 2 also contains a pressure line 53 connected upstream of the air funnel 15 and leading to a first chamber 54 of a servo motor 55 which is separated by a control diaphragm 56 from a second pressure chamber 57. The latter is connected via a line 58 with the induction tube downstream of the air funnel 15 and includes a compression spring 59 exerting a force on the diaphragm 56. Attached to the diaphragm 56 is a slide 60 which controls the flow in a pressure line 61 connected between the chamber 34 and the fuel supply line 20 upstream of the differential pressure valve 28. The differential pressure across the diaphragm in normal operation is insufficient to move the slide 60 in the direction of opening the line 61; however, at maximum rpm of the engine, after the pivotal arm 17 has moved against the stop 52, the differential pressure acting against the spring 59 increases to a point where the slide 60 opens the line 61, permitting the system pressure to reach the chamber 34 and thus displacing the fuel metering member 8 in the direction of a reduced amount of fuel. In this manner, the maximum rpm of the engine is limited in simple and effective fashion.

The construction illustrated in the second exemplary embodiment according to FIG. 2 also permits an adjustment of the maximum fuel quantity on the basis of operational parameters of the engine via the controlled electromagnetic valve 40. As already described in connection with FIG. 1, the differential pressure exerted by the spring 30 may also be changed in dependence on temperature. Further adjustments are possible by adjusting the pressure control valve 22 which alters the system pressure in the fuel supply line 20 upstream of the flow cross section 25. This adjustment may be made in dependence on fuel temperature or other engine parameters, or on the ambient pressure. All the advantages recited with respect to the previous embodiment are valid for the embodiment according to FIG. 2. The main purpose of the fuel injection pump 7 is to provide the required injection pressure and the uniform distribution of the fuel quantity delivered for each power stroke to the injection locations. The precise metering of the overall quantity however is performed by the metering valve 18 which defines the flow cross section 25 the size of which determines the amount of fuel delivered and according to which the fuel quantity adjustment member 8 is displaced with due consideration of the engine speed and the resulting required fuel quantity per stroke. The force required to set the fuel quantity adjustment member is independent of rpm.

Figure 3:
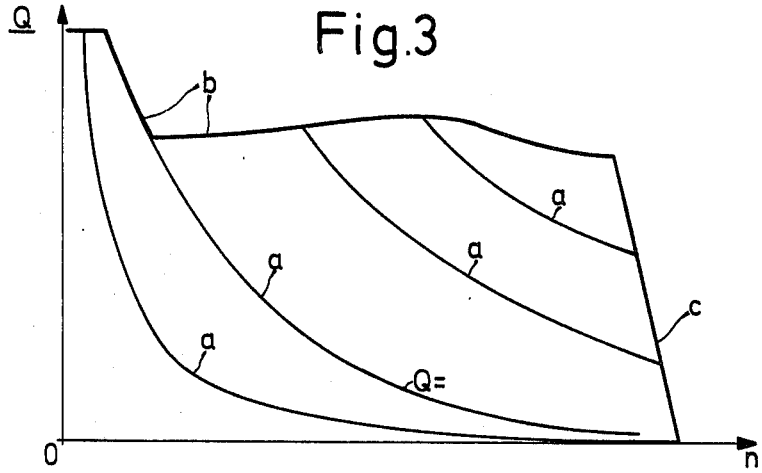
FIG. 3 is a diagram illustrating the fuel quantity per power cycle as a function of rpm for various constant fuel rates.
Figure 4:
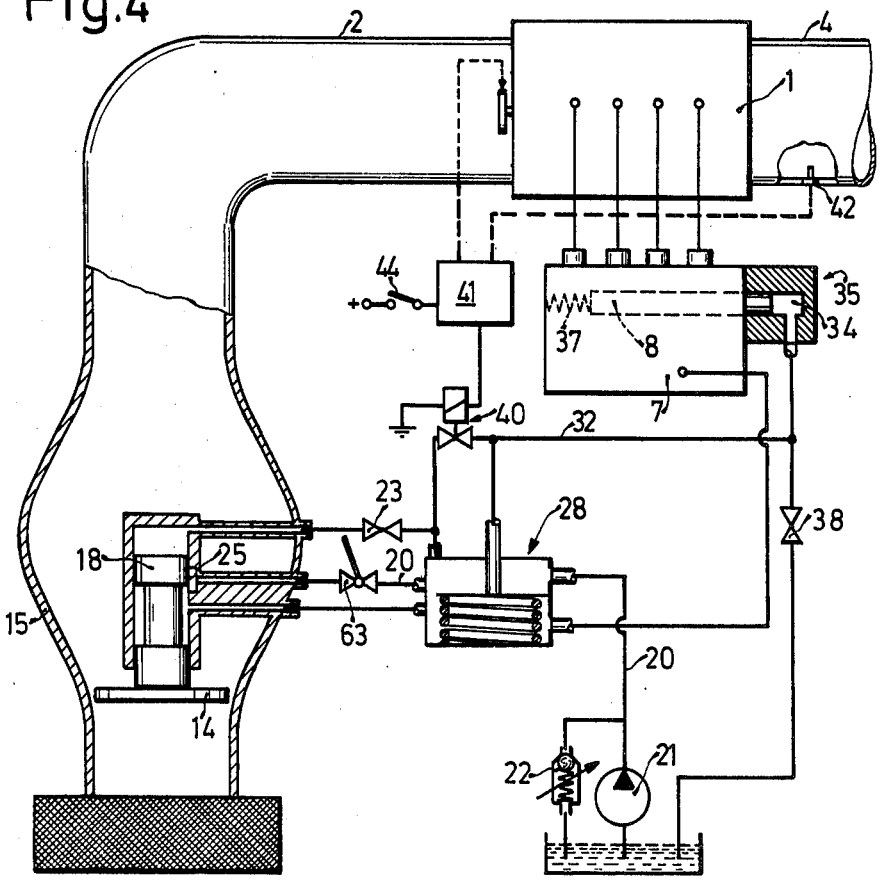
FIG. 4 is an illustration of a third exemplary embodiment of the invention with arbitrary change of the flow cross section of the fuel throttling member.

FIG. 3 is a diagram showing a family of curves which define the fuel quantity Q per stroke as a function of engine speed for various constant fuel rates. The behavior illustrated here can be realized with the aid of the previously described exemplary embodiments. The curves labeled "a" indicate the hyperbolic dependence of the injection quantity per stroke as a function of time for constant fuel flow rate i.e. a constant setting of the adjustable stop 48. The curve b shows the behavior of the maximum delivered fuel quantity as a function of rpm. This curve may be obtained for example at constant differential pressure by the appropriate shaping and profiling of the air funnel 15. The curve c is the shut-off control curve at maximum rpm which is obtained by actuating the slide 60 on the basis of the differential pressure. The slope of this curve is given by the spring constant of the spring 59. A third exemplary embodiment of the invention is illustrated in FIG. 4 which is similar in construction to that of FIG. 2. Identical elements have retained the same reference numerals and the description of these parts and their function is the same as that previously given. By contrast to the previous embodiment, the airflow meter 13 has only a disc 14 which acts directly on the control slide 18 contained in the induction tube and subject to a restoring force of system pressure. Upstream of the metering cross section 25, the fuel supply line 20 contains a throttle 63 which can be adjusted arbitrarily by the accelerator pedal 62. The adjustment mechanism for the control slide 18 described with respect to FIG. 2 and including the adjustable stop 48, the intermediate lever 45 and the spring 50 is absent in the embodiment of FIG. 3. The adjustable throttle 63 causes the system pressure in the fuel supply line 20 upstream of the metering cross section 25 to be prethrottled to varying degrees so that a changeable differential pressure occurs across the metering aperture which is arbitrarily changeable and independent of the differential pressure determined by the differential pressure valve 28. If the size of the throttle 63 is kept constant, the fuel versus rpm curves are similarly hyperbolic for constant fuel delivery rate. The present embodiment brings the advantage that the lever 62 may be moved essentially without the exertion of force and independent of the prevailing operational state of the engine. The advantages previously described with respect to the other embodiments still obtain here, as well as the possibilities for adjusting the fuel injection on the basis of operational parameters.

Figure 5:
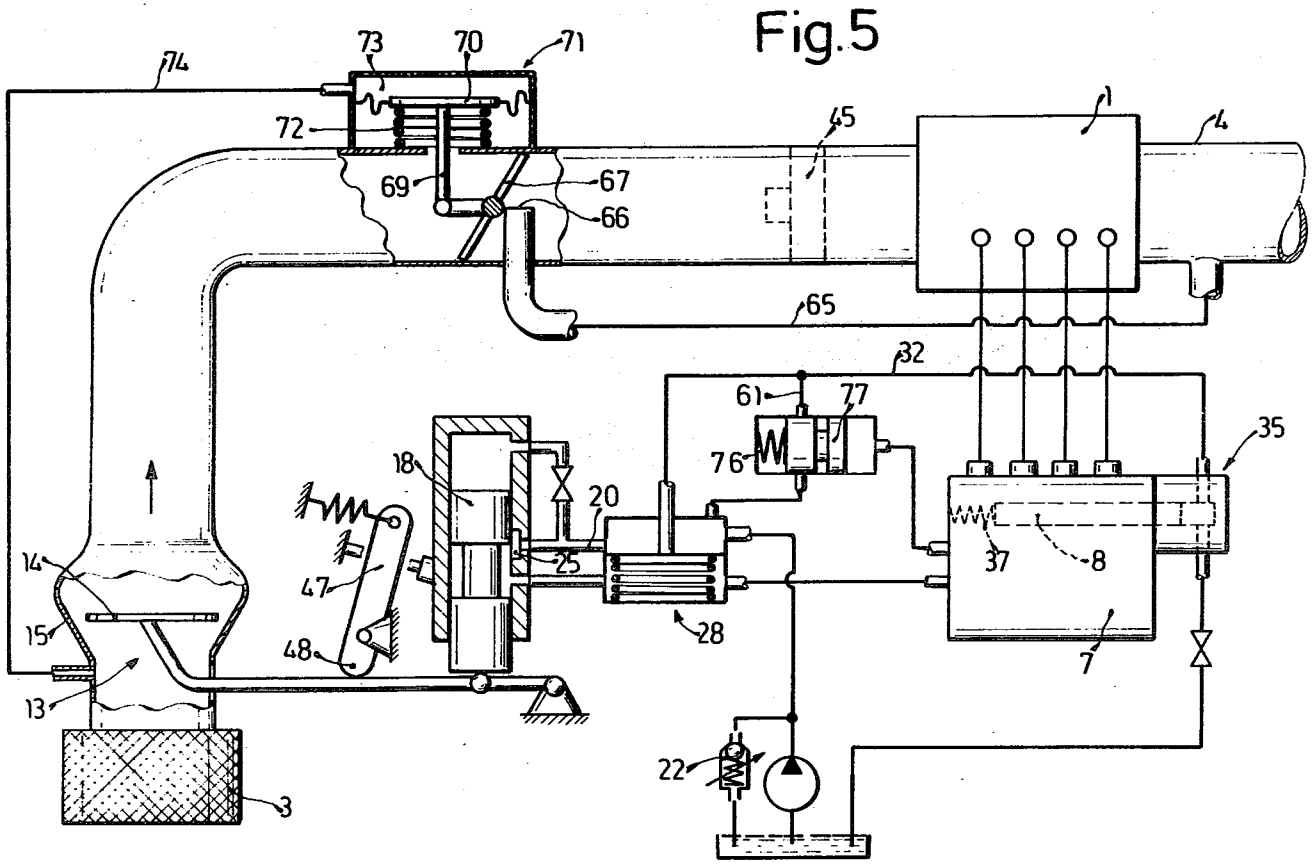
FIG. 5 is a fourth exemplary embodiment of the invention including controlled exhaust gas recycling.

A fourth exemplary embodiment of the invention is illustrated in FIG. 5. By contrast to the embodiment of FIG. 2, there is provided here an exhaust gas return line 65 which connects a portion of the exhaust manifold 4 with the induction tube downstream of the air funnel 15 and upstream of the supercharger 45 if one is present. If a pressure gradient exists from the exhaust manifold to the induction side of the supercharger, the exhaust gas return line may also terminate downstream of the supercharger. In that case, the supercharger is located upstream of throttle valve 67. In the first mentioned arrangement, the exhaust gas return line terminates in the induction tube 2 at right angles and its exit 66 lies in the center of the induction tube. Directly upstream of the terminus 66 is a throttle valve 67, the downstream portion of which is capable of closing the terminus 66 whenever the throttle valve is fully open. The throttle valve is actuated by a servo motor 71 acting via a diaphragm 70 and linkage 69. The side of the control diaphragm adjacent the induction tube experiences the induction tube pressure and the force of a spring 72 tending to open the throttle valve. A pressure chamber 73 defined by the opposite side of the control diaphragm and the housing of the pressure cell 71 is connected via a line 74 to an induction tube region lying between the air filter 3 and the air funnel 15.

A further distinction with respect to the exemplary embodiment of FIG. 2 is that the line 61 connecting the fuel supply line 20 upstream of the orifice 25 and the pressure chamber 34 contains a slide 77 moving in opposition to a spring 76. The slide 77 may be displaced by a centrifugal governor of known construction or by the fluid pressure of an injection onset controller commonly used together with fuel injection pumps. In this manner, the maximum speed of the engine may be limited in a simple way, namely by permitting the slide 77 to conduct system pressure into the chamber 34 when the engine reaches top rpm. The apparatus illustrated in FIG. 5 operates in the following manner. As in the embodiment of FIG. 2, the maximum size of the metering orifice 25 is determined by the position of the lever 45 or of the adjustable stop 48. The motion of the fuel quantity control member 8 in accordance with the size of the opening is performed in the same manner as previously described with respect to FIG. 2. However, the pressure of the throttle valve 67 causes the pressure drop across the disc 14 to be constant as determined by the characteristics of the spring 72. This spring is a very pliable spring so that small displacements still retain a substantially constant force. It is also possible, although somewhat more expensive, to provide a constant restoring force by means of fluid pressure in a similar manner as acts against the control slide 18. Thus the force of the spring 72 causes the control diaphragm 70 to experience the same pressure difference as the disc 14 of the airflow meter 13. For example, if the lever 45 is shifted in the direction of an increased fuel quantity, the motion of the disc 14 causes a short-term increase of the pressure in the induction tube upstream of the throttle valve 67. The disturbed pressure balance at the control diaphragm 70 now causes the throttle valve 67 to be opened somewhat, thereby permitting vacuum from the engine to engage portions of the induction tube upstream of the throttle valve 67 until such time as the original pressure drop across the disc 14 has been restored. At the same time, the throttle valve 67 has moved closer to the terminus 66 of the exhaust gas return line so that the amount of recycled exhaust gas is reduced corresponding to the increase of aspirated fresh air. When the engine is operating at full load, the throttle valve 67 is fully opened, thereby fully closing the exhaust gas return line. This state is reached by choosing the differential pressure at the diaphragm 70, as determined by the spring 72, to be greater than the differential pressure across the disc 14 in the full-load position of the lever 45. An additional advantage of this construction is that the full power of the engine at full load rpm is not reduced by exhaust gas recycling.

In the embodiment just described and illustrated in FIG. 5, the throttle valve 67 is thus caused to follow displacements of the disc 14 which result in changes of the free annular flow cross section between the disc 14 and the air funnel 15. Furthermore, a constant pressure drop is maintained across the disc 14 so that the air quantity fed to the engine is proportional to the annular flow cross section between the disc and the air funnel. The remaining charge admitted to the cylinders is made up of exhaust gas. In order to reduce the NOx content, the maximum exhaust quantity is recycled in the partial load domain. By suitably shaping the air funnel and the pressure difference acting on the disc 14, it is possible to choose an air factor which lies just below the smoke limit in a diesel engine and which maintains low HC and CO components in the exhaust gas.

At full load operation, the throttle valve 67 is fully opened and the exhaust gas recycling is completely interrupted. In that state, the ratio of the air quantity to the fuel quantity is determined only by the induction tube contour and the force exerted on the control slide 18 as well as the differential pressure effective at the metering cross section 25. The apparatus described above is also usable for turbo-charged engines as well as in those engines which reduce the output of hydrocarbons at low load by shutting off the fuel supply to one or more cylinders of the engine. The performance of the vehicle is not diminished because the fuel quantity is metered outside of the fuel injection pump. An additional advantage provided by the apparatus of the invention is a reduction of the noise level of aspiration and exhaust because in partial load operation, the exhaust gas recycling reduces the aspirated fresh air quantity as well as the quantity of exhaust.

The various embodiments of the invention described above can also be suitably combined with one another; for example, the adjustable stop 48 may be directly associated with the control slide instead of engaging it via the pivotal arm 17. Furthermore, temperature compensation may be obtained by inserting a bimetallic member ahead of the stop 48. In that case, the effective position of the stop would be displaced in the direction of a reduced quantity of fuel for the purpose of engine starting enrichment at low ambient temperatures. The mechanical elements described for regulating the various elements of the apparatus can also be substituted for with suitable and known electrical or electromechanical means to perform an equivalent function.

The foregoing relates to preferred exemplary embodiments of the invention, it being understood that other embodiments and variants are possible within the spirit and scope of the invention.

What is claimed is:

1. An apparatus for regulating the fuel-air ratio of the combustible mixture for an internal combustion engine, said apparatus including: a main fuel metering system actuated by a control rod for providing metered amounts of fuel to the injection valves of the engine; an airflow metering device; a fuel flow valve having an adjustable flow crossection and serving to control the flow of fuel to said main fuel metering system; and a comparator for performing a comparison of the flow of fuel through said flow valve with the flow of fuel into said main fuel metering system, and wherein the improvement comprises: adjuster means; an arbitrarily settable control lever; a restoring spring for the control rod; and a relief line containing a throttle, wherein:

(i) said fuel flow valve is actuated by said airflow metering device;

(ii) said control rod is coupled to said arbitrarily settable control lever;

(iii) said comparator is a differential pressure valve connected in parallel with said fuel flow valve, said differential pressure valve having two chambers, one of which is a pressure controlled chamber, with the pressure controlled chamber being connected through the relief line containing the throttle to the adjuster means; and (iv) said adjuster means includes a final control element coupled to the control rod, whereby the control rod may be displaced in opposition to said restoring spring, said adjuster means being actuated by said differential pressure valve for causing a corrective displacement of the control rod in response to the results of the comparison performed by said differential pressure valve.

2. An apparatus as defined in claim 1, wherein said comparator is a differential pressure valve with a diaphragm defining the pressure controlled chamber and an uncontrolled chamber as the other of said two chambers, and wherein the pressure controlled chamber of said differential pressure valve includes a valve seat which cooperates with said diaphragm wherein said valve seat is connected to said adjuster means and further comprising spring means for biasing said diaphragm in the direction of closure.

3. An apparatus as defined by claim 1 wherein said adjuster means is connected by a hydraulic line with the fuel supply line upstream of said fuel flow valve, and wherein said hydraulic line contains a valve which is adjustable in response to one or more operational parameters of the engine.

4. An apparatus as defined in claim 3 wherein said valve in said hydraulic line is an electromagnetic valve and wherein said apparatus includes an electronic controller responsive to operational engine parameters for actuating said electromagnetic valve.

5. An apparatus as defined by claim 4 wherein said electromagnetic valve is open when currentless.

6. An apparatus as defined in claim 5 wherein said electromagnetic valve is operated cyclically and therein said operational parameter is the exhaust gas composition of said engine.

7. An apparatus as defined by claim 1 further comprising a line connecting the fuel supply of said apparatus with said adjuster means and containing a valve with two chambers, one of said two chambers being connected to said induction tube at a point of narrowest cross section and the other of said two chambers being connected to said induction tube at a point of largest cross section.

8. An apparatus as defined by claim 1 wherein a hydraulic line is provided to connect said adjuster means with the fuel supply line upstream of said fuel flow valve, said hydraulic line containing a valve which can be actuated in RPM dependent manner.

9. An apparatus as defined by claim 8 wherein said valve in said hydraulic line is actuated by said main fuel metering device.

10. An apparatus as defined by claim 1 wherein said airflow meter is a disc moving in said induction tube and further comprising bimetallic means connected between said disc and said fuel flow valve to provide temperature dependent actuation thereof.

11. An apparatus as defined in claim 1 wherein said fuel flow valve is subject to a restoring force which is provided in dependence on operational engine parameters.

12. An apparatus as defined in claim 11 further comprising means for changing the fluid pressure acting on said fuel flow valve in dependence on ambient pressure.

13. An apparatus as defined by claim 1 further comprising a conduit leading from the exhaust manifold of said engine to the induction tube of said engine and means within said induction tube for controlling the amount of exhaust gas returned to said induction tube thereby changing the amount of fresh air admitted to the engine.

14. An apparatus as defined by claim 13 wherein said conduit terminates in said induction tube and there is disposed in said induction tube a moveable valve member for controlling the flow through said conduit depending on the pressure difference across said airflow metering device.

15. An apparatus as defined in claim 14 wherein said movable valve member in said induction tube is a throttle flap and wherein the improvement further comprises means connected to said induction tube upstream and downstream of said airflow metering device for changing the position of said throttle flap, said throttle flap being so disposed that it opens the terminus of said conduit from said exhaust manifold when obturating said induction tube.

16. An apparatus as defined by claim 15 wherein said means for adjusting said throttle flap is opposed by a substantially constant force.

17. An apparatus as defined by claim 1 further comprising turbo charger means located in the induction tube of the engine downstream of said airflow metering device.

18. An apparatus for regulating the fuel-air ratio of the combustible mixture for an internal combustion engine, the engine having an air induction tube, said apparatus including: a main fuel metering system actuated by a control rod for providing metered amounts of fuel to the injection valves of said engine; an airflow metering device; a fuel flow valve having an adjustable flow crossection and serving to control the flow of fuel to said main fuel metering system; and a comparator for performing a comparison of the flow of fuel through said flow valve with the flow of fuel into said main fuel metering system, and wherein the improvement comprises: adjuster means; an arbitrarily settable stop; a restoring spring for the control rod; and a relief line containing a throttle, wherein:

(i) said fuel flow valve is actuated by said airflow metering device;

(ii) said airflow metering device comprises a baffle plate disposed in the induction tube and moveable in response to the airflow in the induction tube and within a funnel shaped region of the induction tube, said baggle plate being coupled to said fuel flow valve and including means providing a return force on said baffle plate in opposition to said airflow;

(iii) said arbitrarily settable stop is provided for limiting the motion of said baffle plate;

(iv) said comparator is a differential pressure valve connected in parallel with said fuel flow valve, said differential pressure valve having two chambers, one of which is a pressure controlled chamber, withe the pressure controlled chamber being connected through the relief line containing the throttle to the adjuster means; and (v) said adjuster means includes a final control element coupled to the control rod, whereby the control rod may be displaced in opposition to said restoring spring, said adjuster means being actuated by said differential pressure valve for causing a corrective displacement of the control rod in response to the results of the comparison performed by said differential pressure valve.

19. An apparatus as defined by claim 18 wherein said baffle plate is attached to the moveable end of a lever, the other end of which is mounted pivotably and further comprising an intermediate lever coupled to said lever by a spring, said intermediate lever being actuated by said fuel flow valve and wherein said settable stop limits the motion of said intermediate lever.

20. An apparatus as defined by claim 17 further comprising a second adjustable stop for limiting the maximum displacement of said baffle plate.

21. An apparatus for regulating the fuel-air ratio of the combustible mixture for an internal combustion engine, said apparatus including: a main fuel metering system actuated by a control rod for providing metered amounts of fuel to the injection valves of said engine; an airflow metering device; a fuel flow valve having an adjustable flow crossection and serving to control the flow of fuel to said main fuel metering system; and a comparator for performing a comparison of the flow of fuel through said flow valve with the flow of fuel into said main fuel metering system, and wherein the improvement comprises: adjuster means; a restoring spring for the control rod; a relief line containing a throttle; and an adjustable throttle, wherein:

(i) said fuel valve is actuated by said airflow metering device;

(ii) said adjustable throttle is disposed in the fuel supply line of the apparatus upstream of said fuel flow valve;

(iii) said comparator is a differential pressure valve connected in parallel with said fuel flow valve, said differential pressure valve having two chambers, one of which is a pressure controlled chamber, with the pressure controlled chamber being connected through the relief line containing the throttle to the adjuster means; and (iv) said adjuster means includes a final control element coupled to the control rod, whereby the control rod may be displaced in opposition to said restoring spring, said adjuster means being actucated by said differential pressure valve for causing a corrective displacement of the control rod in response to the results of the comparison performed by said differential pressure valve.

* * * * *